US006840204B1

(12) United States Patent
Brassell

(10) Patent No.: US 6,840,204 B1
(45) Date of Patent: Jan. 11, 2005

(54) MOUNTING SYSTEM FOR AN AIR INTAKE MANIFOLD ASSEMBLY

(75) Inventor: David Brassell, Walled Lake, MI (US)

(73) Assignee: Hayes Lemmerz International, Inc., Northville, MI (US)

( * ) Notice: Subject to any disclaimer, the term of this patent is extended or adjusted under 35 U.S.C. 154(b) by 64 days.

(21) Appl. No.: 10/303,257

(22) Filed: Nov. 25, 2002

(51) Int. Cl.[7] ..... F02M 19/00
(52) U.S. Cl. ..... 123/184.21
(58) Field of Search ..... 123/184.21–184.61, 123/568.17; 261/65

(56) References Cited

U.S. PATENT DOCUMENTS

| | | | | |
|---|---|---|---|---|
| 2,281,694 A | | 5/1942 | Huber | |
| 3,975,468 A | * | 8/1976 | Tuckey | 261/65 |
| 4,301,775 A | | 11/1981 | Smart et al. | |
| 4,776,313 A | | 10/1988 | Freismuth et al. | |
| 4,805,564 A | | 2/1989 | Hudson, Jr. | |
| 5,235,938 A | | 8/1993 | Haussmann et al. | |
| 5,341,772 A | * | 8/1994 | Dohring et al. | 123/568.17 |
| 5,341,773 A | | 8/1994 | Schulte et al. | |
| 5,501,075 A | | 3/1996 | Spies et al. | |
| 5,595,151 A | | 1/1997 | Powell et al. | |
| 5,636,605 A | | 6/1997 | Nomizo et al. | |
| 5,653,200 A | | 8/1997 | Hafner et al. | |
| 5,655,492 A | | 8/1997 | Sattler et al. | |
| 5,664,533 A | | 9/1997 | Nakayama et al. | |
| 5,970,939 A | | 10/1999 | Motosugi et al. | |
| 5,992,369 A | | 11/1999 | Mehne | |
| 6,213,077 B1 | * | 4/2001 | Horii | 123/184.57 |
| 6,536,394 B2 | * | 3/2003 | Schneider | 123/184.21 |

FOREIGN PATENT DOCUMENTS

CH 658 702 11/1986

* cited by examiner

*Primary Examiner*—Marguerite McMahon
(74) *Attorney, Agent, or Firm*—MacMillan, Sobanski & Todd, LLC

(57) ABSTRACT

A mounting system for the air intake manifold assembly for attaching portions of an intake manifold. The system has an upper body part and a lower body part and is used for an internal combustion engine. The system includes a notch. The notch includes a lower surface and the notch is formed in the upper body part of the intake manifold. The system includes a mounting tab. The mounting tab includes a bottom wall. The mounting tab is formed in the lower body part of the intake manifold. A substantial portion of the lower surface of the notch and a substantial portion of the bottom wall of the mounting tab contact one another to couple the upper body part of the intake manifold and the lower body part of the intake manifold together.

16 Claims, 6 Drawing Sheets

MOUNTING SYSTEM FOR AN AIR INTAKE MANIFOLD ASSEMBLY

BACKGROUND OF THE INVENTION

This invention relates in general to vehicle engines and in particular to an improved mounting system for an intake manifold assembly for use in such a vehicle engine.

An intake manifold assembly of a multi-cylinder engine includes a plurality of branched air passageways or ducts. Each of the air passageways defines a generally tubular runner having an air intake port and an opposite air inlet port. The air intake port of the runner is joined to an associated plenum which supplies atmospheric, turbo, or supercharged air to the runner intake port, and the air inlet port is joined to a flange which is joined to an associated inlet port of each cylinder head of the engine to supply the air from the runner to each cylinder head. Conventional intake manifold assemblies are constructed of cast iron, magnesium, aluminum, and plastic.

A typical aluminum intake manifold assembly is produced entirely by conventional casting process. These manifolds typically include a plurality of tubes disposed having first ends joined with the outlet holes of an air intake plenum, and second opposite ends joined with the associated holes of a flange member which is adapted for mounting to a cylinder head of the engine. Since the tubes are usually U-shaped, the manifold cannot be cast in one piece but rather must be cast in two body sections or halves, with one section comprising a length of the tubing cast integrally with the plenum and the other section comprising the remaining length of the tubing cast integrally with the flange member.

The establishment of effective and durable seals between the sections is needed for proper function of a machine using a manifold, such as an automobile, particularly where the manifold is a conduit for hot gases or fluids passing through or near the manifold. Typically, the sections are joined together with bolts and a gasket or other suitable hardware to complete the manifold, further adding to the cost and complexity of the manifold. The use of fasteners can be labor-intensive, costly, and consume an excessive amount of the limited space of the intake manifold. Thus, it would thus be desirable to produce an improved mounting system for use with an air intake manifold assembly.

SUMMARY OF THE INVENTION

Applicant has discovered that in the particular manifold assembly structure disclosed herein, typical fasteners could not be used on a "near" side to join the upper and lower body parts together because the associate runner tracks were too close together. Even in constructions where typical fasteners could be used, the present invention could reduce the cost associated with joining the body parts together using conventional fasteners. In accordance with the mounting system of this invention, the lower and upper parts of the manifold assembly are sealed using notches to cause a tight condition on a first or near side and using fasteners to draw down an opposite second or far side. In particular, the mounting system has an upper body part and a lower body part and is used for an internal combustion engine. The system includes a notch. The notch includes a lower surface and the notch is formed in the upper body part of the intake manifold. The system includes a mounting tab. The mounting tab includes a bottom wall. The mounting tab is formed in the lower body part of the intake manifold. A substantial portion of the lower surface of the notch and a substantial portion of the bottom wall of the mounting tab contact one another to couple the upper body part of the intake manifold and the lower body part of the intake manifold together.

Other advantages of this invention will become apparent to those skilled in the art from the following detailed description of the preferred embodiments, when read in light of the accompanying drawings.

DETAILED DESCRIPTION OF THE PREFERRED EMBODIMENTS

Preliminarily, it should be noted that certain terms used herein, such as "front", "back", "bottom", "top", "upper", and "lower" are used to facilitate the description of the preferred embodiment of the invention. Such terms are not intended as a limitation on the position in which the components of the invention may be used.

Figure 2:
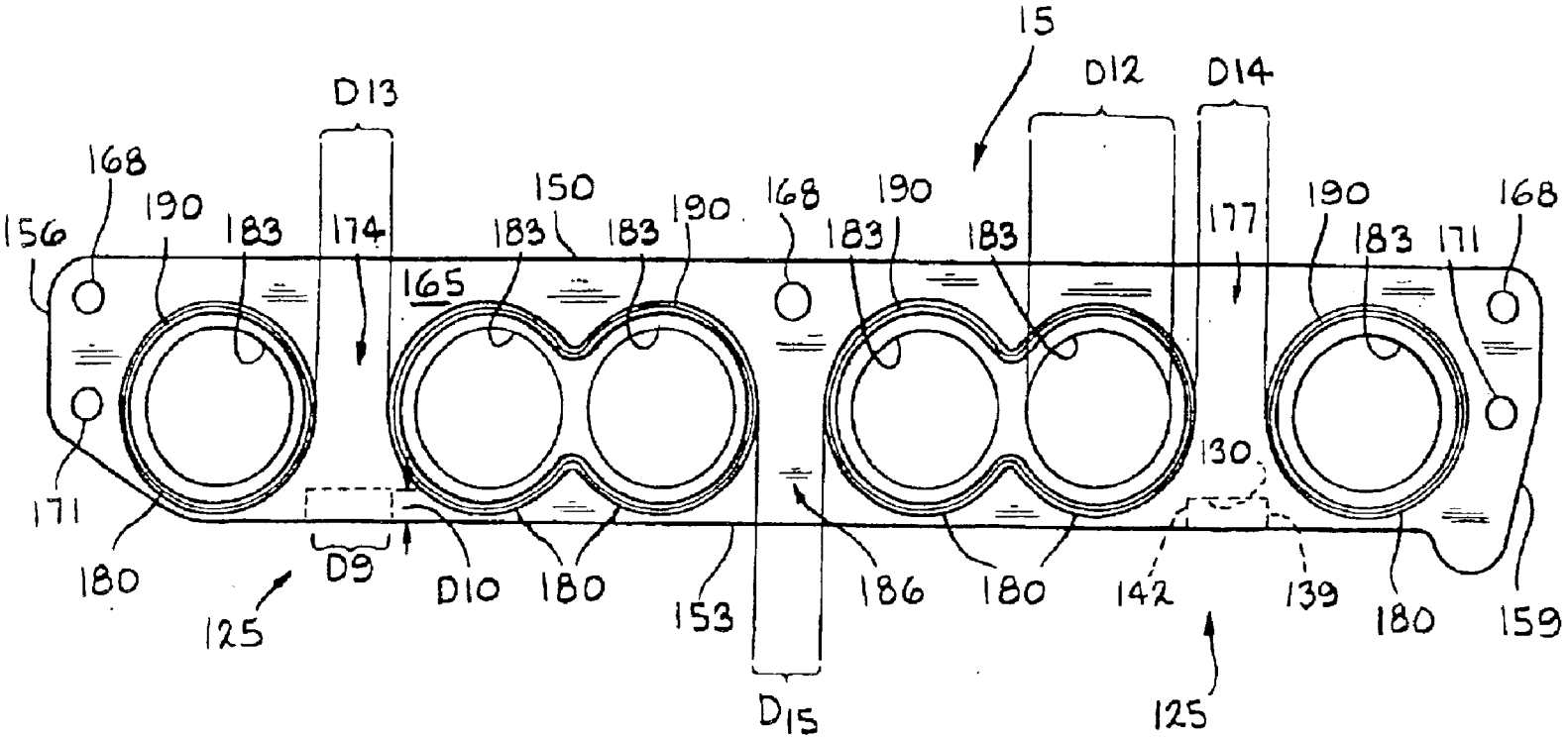
FIG. 2 is a plan view of an upper body part used in the mounting system of the present invention to produce the first embodiment of the air intake manifold assembly according to the present invention.
Figure 3:
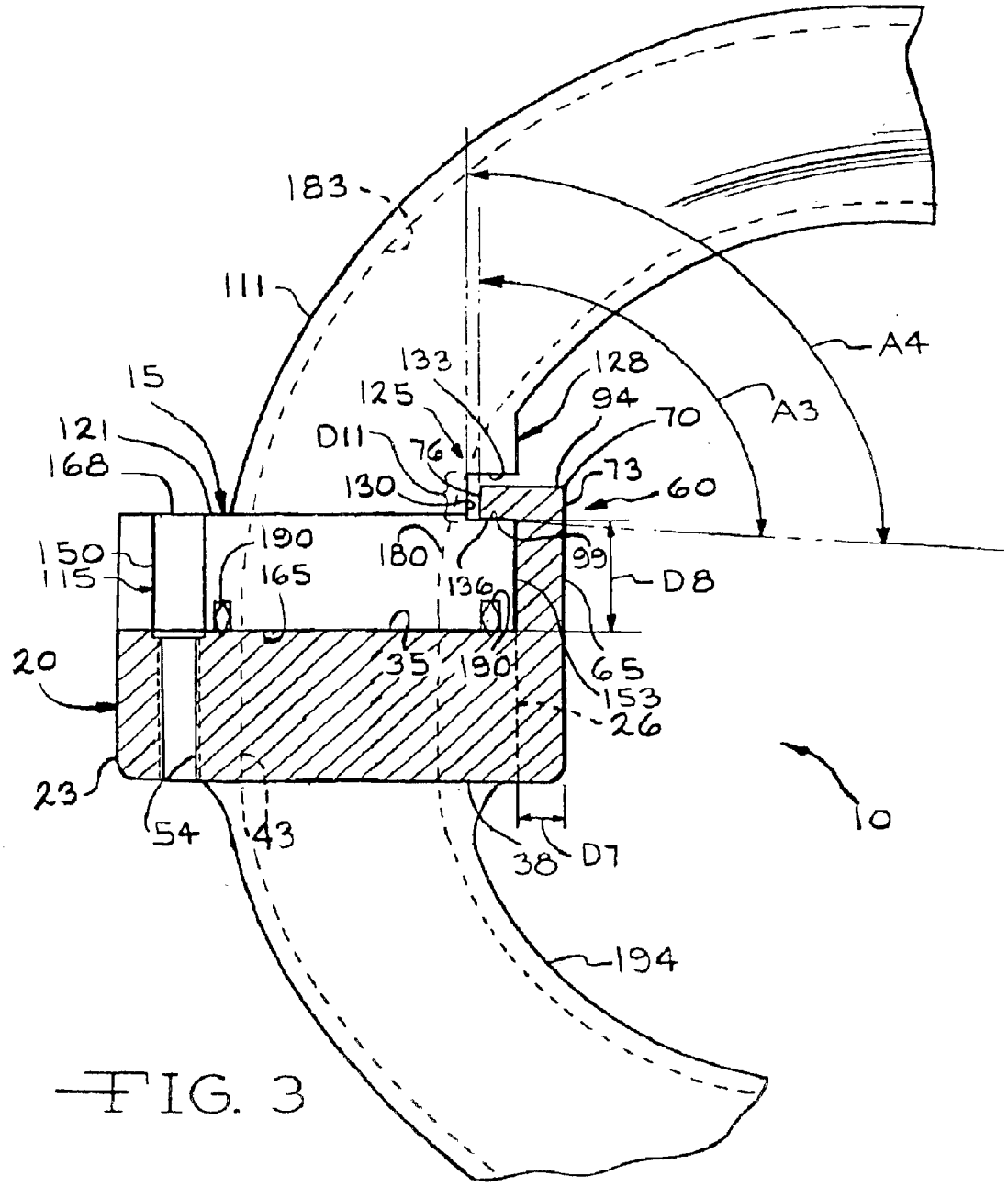
FIG. 3 is a sectional view of an air intake manifold assembly according to a first embodiment of the present invention, showing the lower body part of FIG. 1 and the upper body part of FIG. 2 joined together.

Referring now to the drawing, there is illustrated in FIG. 3 a first embodiment of an air intake manifold assembly, indicated generally at 10, including the mounting system in accordance with the present invention. For purposes of clarity in presentation, only those portions of the air intake manifold assembly 10 that are necessary for a complete understanding of this invention will be described. As illustrated in FIG. 3, the air intake manifold assembly 10 includes an upper body part or manifold 15 (best shown in FIG. 2), and a lower body part or manifold 20 (best shown in FIG. 1), operatively joined together in accordance with the mounting system of the present invention.

Figure 1:
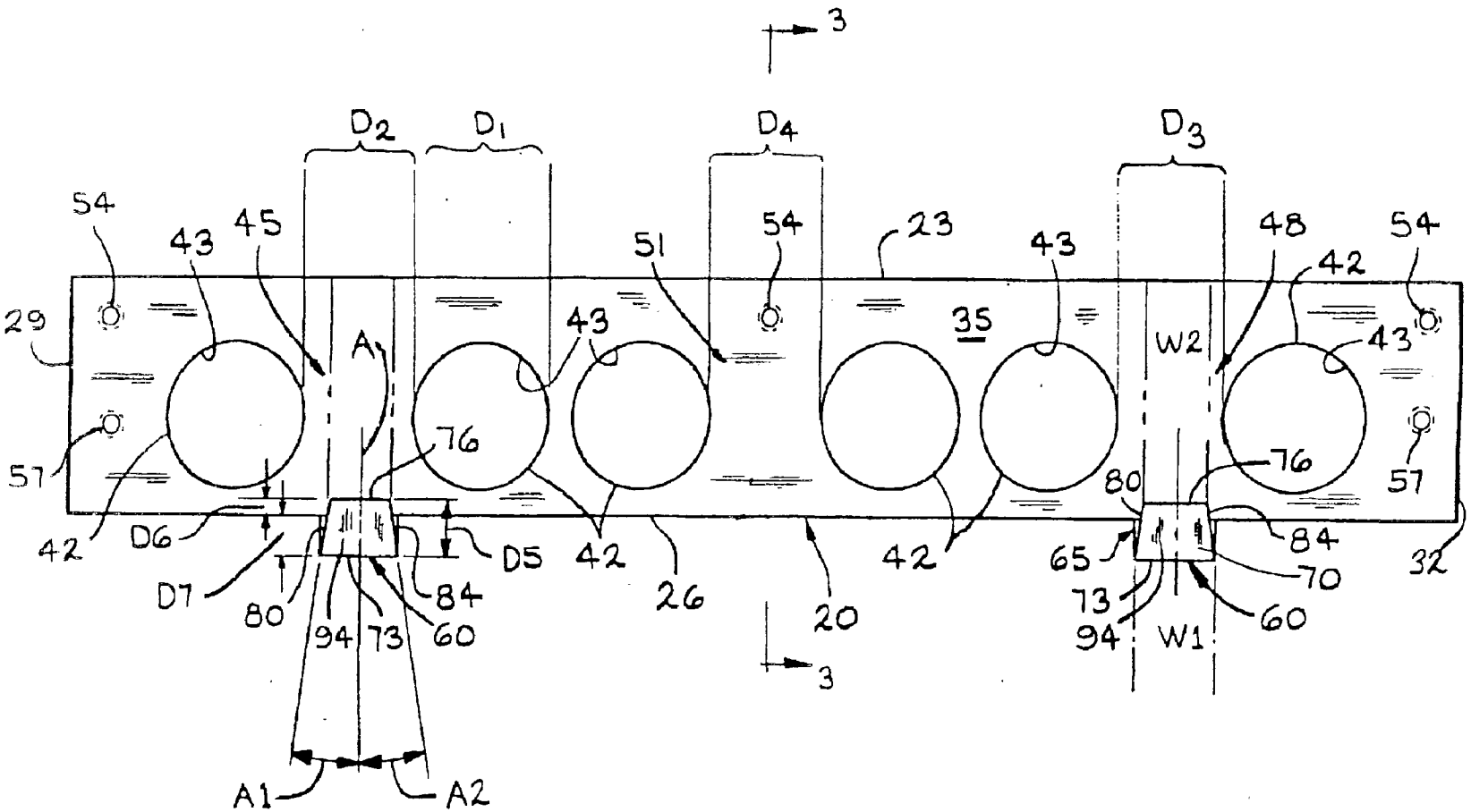
FIG. 1 is a plan view of a lower body part used in the mounting system of the present invention to produce an air intake manifold assembly according to a first embodiment of the present invention.

Referring now to FIG. 1, the lower body part 20, generally referred to as a mounting flange, is constructed from a suitable material, such as for example, plastic or aluminum. The lower body part 20 includes a pair of opposed side walls 23 and 26, and a pair of opposed end walls 29 and 32. The side walls 23 and 26 extend generally parallel to one another, and the end walls 29 and 32 extend generally parallel to one another and generally transverse relative to the side walls 23 and 26. The side wall 23 defines a front wall and the side wall 26 defines a rear wall. The lower body part 20 also includes a generally flat upper surface 35 and a preferably generally flat lower surface 38, shown in FIG. 3.

The lower body part 20 includes one or more generally tubular shaped openings 42 extending therethrough, each opening 42 having an inner wall surface 43. In the illustrated embodiment, the lower body part 20 includes six openings 42 all defining a diameter D1. In the illustrated embodiment, the lower body part 20 is provided with three front fastener holes 54 adjacent the front wall 23. As will be discussed below, the holes 54 are adapted to receive suitable fasteners to join the upper body part 15 and the lower body part 20 together. Any suitable number of front fastener holes 54 may be employed to ensure, in conjunction with the mounting tabs and seals, a sufficient load is established seal the system from leaking to outside air. The front fastener holes 54 may be threaded to receive a bolt, or may be adapted to receive any other suitable fastener.

In the illustrated embodiment, the lower body part 20 is further provided with fastener holes 57 provided near the opposed ends 29 and 32 thereof which are used to join together the upper body part 15 to the lower body part 20. The fastener holes 57 may be threaded to receive a bolt, or may be adapted to receive any other suitable fastener. Any suitable number of fastener holes 57 may be employed. Alternatively, one or more of the front fastener holes 54 and corresponding fasteners and one or more of the end fastener holes 57 and corresponding fasteners could be eliminated.

In the illustrated embodiment, the lower body part 20 is provided with two mounting tabs or projections, indicated generally at 60, extending from the rear wall 26. It should be noted that any suitable number of mounting tabs 60 may be employed. In the illustrated embodiment, the mounting tabs 60 are provided along the rear wall 26 in a space 45 defined generally intermediate to the pair of openings 42 adjacent the end wall 29, and in a space 48 defined generally intermediate to the pair of openings adjacent the end wall 32. It should be noted that the mounting tabs 60 may be provided at any suitable location on the lower body part 20. For example, a mounting tab 60 may be provided in a space 51, or a single continuously extending mounting tab (not shown) may be provided on the lower body part 20 and which extends across the entire portion or a substantial portion thereof.

In the illustrated embodiment, each mounting tab 60 includes a generally upright or vertically extending leg 65 and a generally flat or horizontally extending foot 70. Preferably, the leg 65 and the foot 70 are formed integral with one another and integral with the lower body part 20. As shown in FIG. 3, a bottom wall 99 of the foot 70 of the tab 60 is preferably located above the upper surface 35 of the lower body part 20 by a distance D8 and extends toward the front wall 23 thereof so as to project over a portion of the top surface 35 of the lower body part 20 for a purpose to be discussed below.

In the illustrated embodiment, the mounting tab 60 includes a rear wall 73 which is generally parallel to a front wall 76 of the foot 70 of the tab 60. The rear wall 73 defines a width W1, and the front wall 76 defines a width W2 which is preferably less than the width W1. The rear wall 73 and the front wall 76 of the mounting tab 60 are spaced apart by a distance D5. The rear wall 73 of the mounting tab 60 is spaced from the rear wall 26 of the lower body part 20 by a distance D7, and the front wall 76 of the mounting tab 60 projects over the top surface 35 and is spaced from the rear wall 26 of the lower body part 20 by a distance D6.

The mounting tab 60 further includes two side walls 80 and 84. The side walls 80 and 84 terminate at one end at the rear wall 73 and at the other end at the front wall 76. In the illustrated embodiment, the side walls 80 and 84 are tapered inwardly from the rear wall 73 toward the front wall 76. In particular, the side wall 80 is oriented at an angle A1 with respect to an axis A, and the side wall 84 is oriented at an angle A2 with respect to the axis A. It will be appreciated that the illustrated axis A bisects the mounting tab 60 and is oriented generally perpendicular relative to the rear wall 73 and the front wall 76 thereof, and generally perpendicular relative to the rear wall 26 of the lower body part 20. In the illustrated embodiment, the angle A1 is preferably within the range of from about 45 degrees to about 75 degrees, and the angle A2 is preferably within the range of from about 45 degrees to about 75 degrees. Alternatively, the structure of the side walls 80 and 84 can be other than illustrated if so desired.

In the illustrated embodiment, the foot 70 of the mounting tab 60 includes a top wall 94 and the bottom wall 99. The top wall 94 is generally flat and has a generally quadrilateral shape. In a preferred embodiment, the top wall 94 forms a trapezoid, having only two sides parallel. The bottom wall 99 of the mounting tab 60 is spaced apart from the top surface 35 of the lower body part 20 by a distance D8. The bottom wall 99 of the mounting tab 60 is oriented at an angle A3 relative to the front wall 76 of the foot 70 of the mounting tab 60. The angle A3 is within the range of from about 45 degrees to about 135 degrees. More preferably, the angle A3 is within the range of from about 94 degrees to about 100 degrees.

The upper body part 15 is formed from a suitable material, such as for example, plastic or aluminum and includes one or more tubular shaped members 105, shown in FIG. 3. The members 105 each have an arc profile which defines a generally tubular shaped outer surface 111. Each of the members 105 includes a first or lower mounting end 115 and an opposite second (not shown). The first end 115 of the member 105 includes an upper mating plate 121. The second end of the member 105 is adapted to be joined to an air supply chamber (not shown).

The upper body part 15 is provided with one or more notches 125 formed therein. The number of notches 125 preferably corresponds with the number of mounting tabs 60 provided on the lower body part 20. In the illustrated embodiment, each notch 125 is provided along a portion of the surface 111 of the member 105. In the illustrated embodiment, a ledge or extension 128 is preferably provided above each notch 125 to provide support in the upper body part 15 at each notch 125.

In the illustrated embodiment, each notch 125 includes a rear side wall 130, an upper wall 133, a lower wall 136, and a pair of opposed side walls 139 and 142 shown in FIG. 2. In the illustrated embodiment, the upper wall 133 of the notch 125 is oriented at approximately 90 degrees with respect to the rear side wall 130 of the notch 125, and the rear side wall 130 is oriented at an angle A4 with respect to the lower wall 136 of the notch 125. The angle A4 is within the range of from about 45 degrees to about 135 degrees and more preferably within the range of from about 94 degrees to about 100 degrees. Alternatively, the angle A4 may be any suitable angle. Preferably, the angle A3 is greater than the angle A4 with the difference between the two angles being around 5 degrees. The purpose of this difference in the angles is so the upper body part 15 can be slid on the notches 125 at this angle (difference in the surfaces 35 and 165 is the same 5 degrees), so that gaskets 190 will not smear or roll over during assembly. Alternatively, the angles A3 and A4 can be other than shown and illustrated and/or can be different from one another is so desired. For example, the angle A4 of the upper body part 15 and the angle A3 of the lower body part 20 can be approximately equal to one another.

The lower end 115 of the upper body part 15 includes a pair of opposed side walls 150 and 153, and a pair of opposed end walls 156 and 159. The side walls 150 and 153 extend generally parallel to one another, and the end walls 156 and 159 extend generally parallel to one another and generally traverse relative to the side walls 150 and 153. The side wall 150 defines a front wall and the side wall 153 defines a rear wall. The upper body part 15 also includes a generally flat upper mating plate 121 (best seen in FIG. 3) and a preferably generally flat bottom surface 165.

The upper body part 15 is provided with three front fastener holes 168 adjacent the side wall 150 to receive a suitable fastener to join the upper body part 15 to the lower body part 20. Any suitable number of front fastener holes 168 may be employed. The front fastener holes 168 may be threaded to receive a bolt, or may be adapted to receive any other suitable fastener. The front fastener holes 168 of the upper body part 15 preferably align with the front fastener holes 54 of the lower body part 20. Alternatively, the holes 54 and 168 can be eliminated if so desired.

The upper body part 15 is provided with fastener holes 171 near the opposed ends 156 and 159 thereof to join the upper body part 15 to the lower body part 20. The fastener holes 171 may be threaded to receive a bolt, or may be adapted to receive any other suitable fastener. Any suitable number of middle fastener holes 171 may be employed. The fastener holes 171 of the upper body part 15 align with the fastener holes 57 of the lower body part 20. Alternatively, one or more of the front fastener holes 168 and corresponding fasteners and one or more of the end fastener holes 171 and corresponding fasteners could be eliminated.

In the illustrated embodiment, the notches 125 are provided adjacent the side wall. 153 of the upper body part 15. It should be noted that the notches 125 may be provided at any suitable location provided adjacent the side wall 153. It should be noted that any suitable number of notches 125 may be employed, including but not limited to one. The number of notches 125 preferably corresponds to the number of mounting tabs 60. In the illustrated embodiment, the notches 125 are provided near in a space 174 and in a space 177. Also, a single notch 125 may be employed that extends across a substantial portion of, or all, a portion of the upper body part 15.

The upper body part 15 includes one or more tubular shaped openings 180 extending therethrough and having an inner surface 183. In the illustrated embodiment, the upper body part 15 includes six openings 180. The openings 180 preferably all have the same diameter D12, though any suitable set of diameters may be employed.

The upper body part 15 further includes one or more gaskets or seals 190. The gaskets 190 are preferably made of a suitable resilient material, such as for example silicon. It should be understood that the seals 190 may be made of any suitable resilient material. The seals 190 are preferably provided in a gasket groove G provided about the periphery of the openings 180. The seals 190 are operative to provide an air tight seal between the adjacent mating surfaces of the upper body part 15 and the lower body part 20 when assembled. The upper body part 15 and the lower body part 20 are preferably made of nylon 66 (polyhexamethylene adipamide) or nylon 6 (polycaproamide). Other multipurpose plastics may also be employed. Of course, any suitable material, including metallic compounds, may be used to produce the upper body part 15 and the lower body part 20 according to conventional techniques in the art.

When the upper body part 15 and the lower body part 20 are secured together, the upper body part 15 and the lower body part 20 are positioned with respect to each other to cooperate as shown in FIG. 3. It will be appreciated that the top wall 94 of the foot 70 of the mounting tab 60 and the upper surface 133 of the notch 125 are preferably spaced apart, though they may touch. Likewise, the front surface 76 of the foot 70 of the mounting tab 60 and the inner surface 130 of the notch 125 are preferably spaced apart, though they may touch. Similarly, the side walls 80 and 84 of the mounting tab 60 are preferably spaced apart from the respective side walls 142 and 139 of the notch 125, though they may touch. In the illustrated embodiment, the bottom wall 99 of the foot 70 of the mounting tab 60 and the lower surface 136 of the notch 125 are in contact with each other at the corner thereof. Alternatively, one or more notches 125 could be provided on the lower body part 20 and one or more mounting tabs 60 could be provided on the upper body part 15.

It should be noted that the notch 125 preferably defines a distance D9 (shown in Fig.), a distance D10 (shown in FIG. 2), and a distance D11 (shown in FIG. 3). It will be appreciated that the distance D9 of the notch 125 is equal to or greater than the width W2 of the front surface 76 of the foot 70 of the mounting tab 60 so as to allow the upper body part 15 and the lower body part 20 to be assembled as shown in FIG. 3. Likewise, it will be appreciated that the distance D10 of the notch 125 is equal to or greater than the distance D6 of the foot 70 of the tab 60 so as to allow the upper body part 15 and the lower body part 20 to be assembled as shown in FIG. 3.

It will be appreciated that the illustrated upper body part 15 and lower body part 20 preferably communicate with a suitably shaped tubular shaped lower manifold 194. For the illustrated lower manifold 194, it will be noted that the tubular shaped members 180 of the upper body part 15 are in communication with the lower manifold 194 via the openings 42 of the lower body part 20. In the illustrated embodiment, the lower manifold 194 is connected to and supports the lower body part 20 by suitable means.

Figure 4:
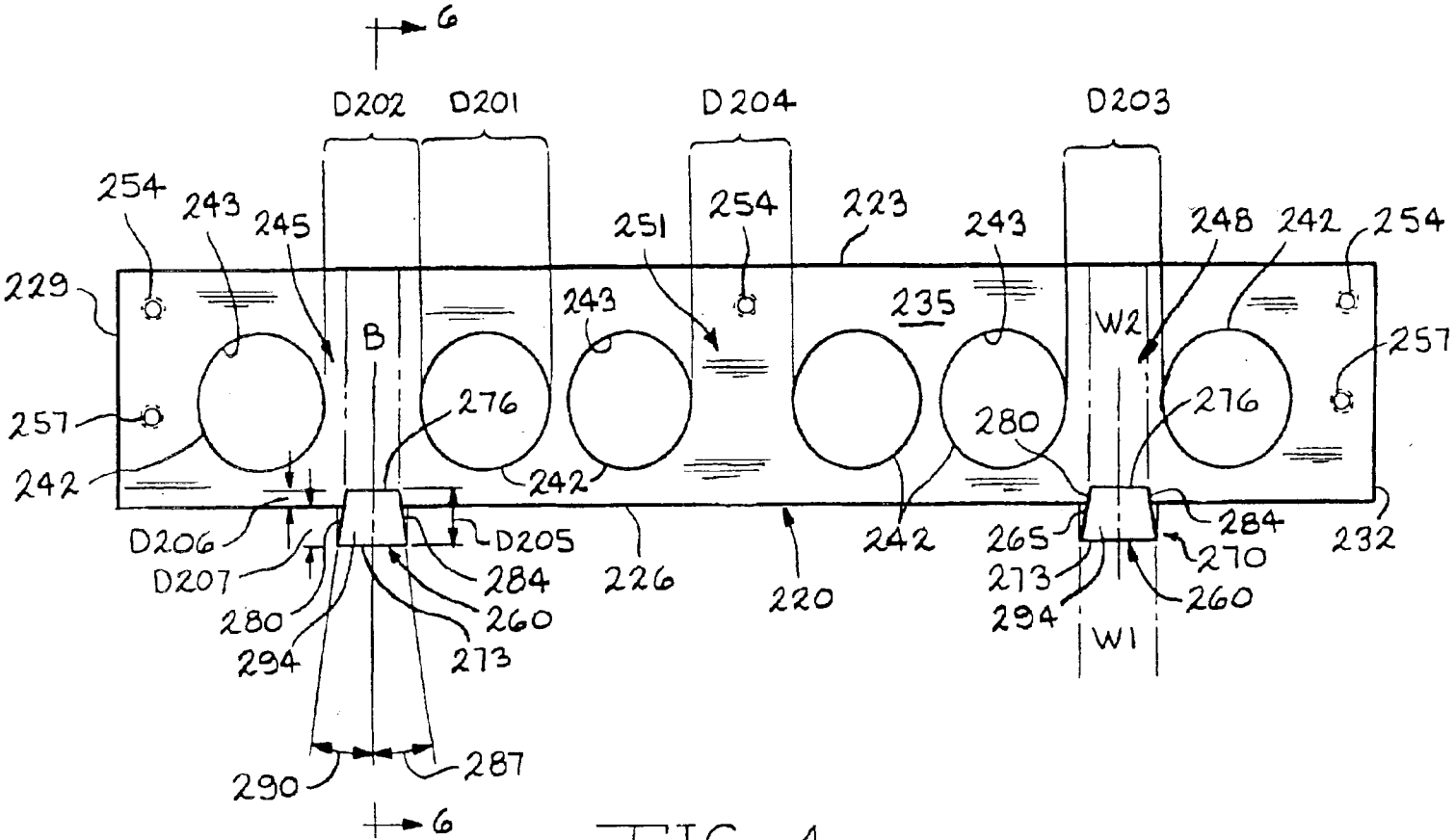
FIG. 4 is a plan view of a lower manifold used in the mounting system of the present invention to produce an air intake manifold assembly according to a second embodiment of the present invention.
Figure 5:
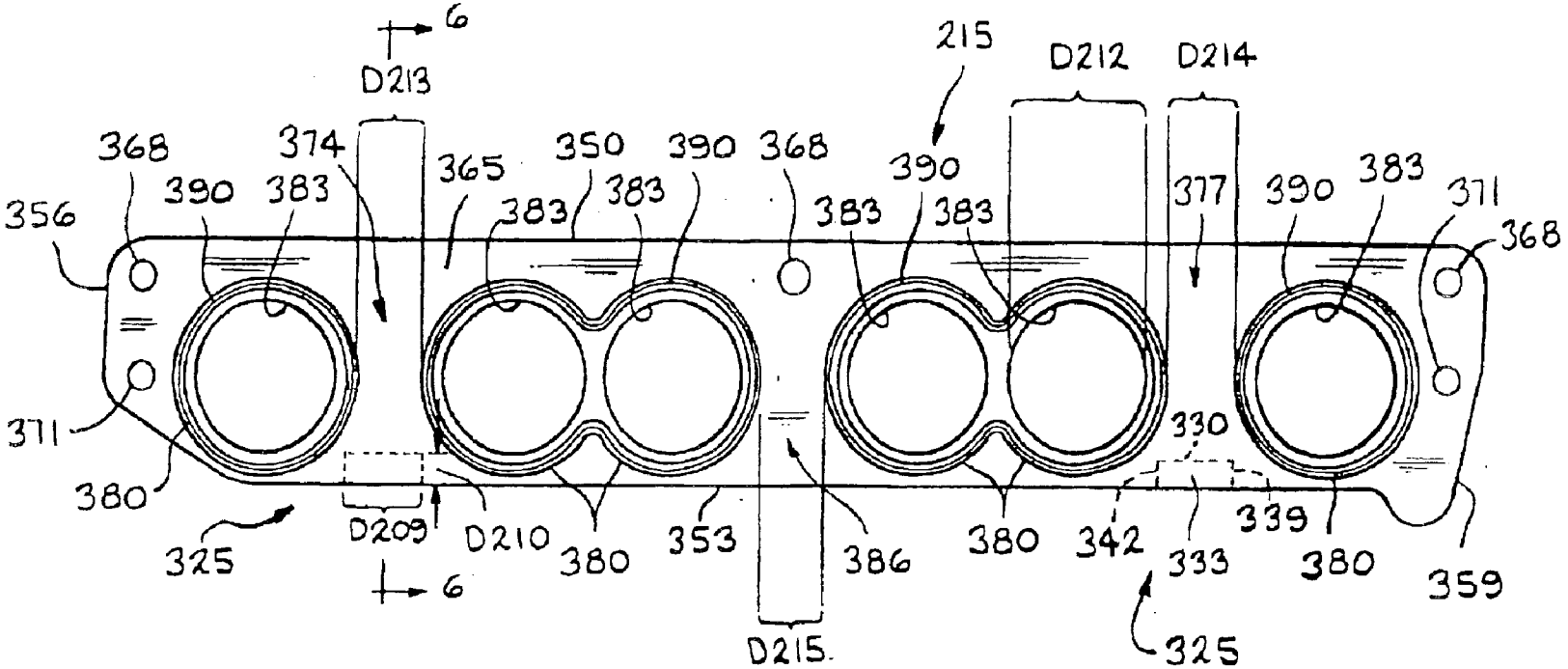
FIG. 5 is a plan view of an upper manifold used in the mounting system of the present invention to produce the second embodiment of the air intake manifold assembly according to the present invention.
Figure 6:
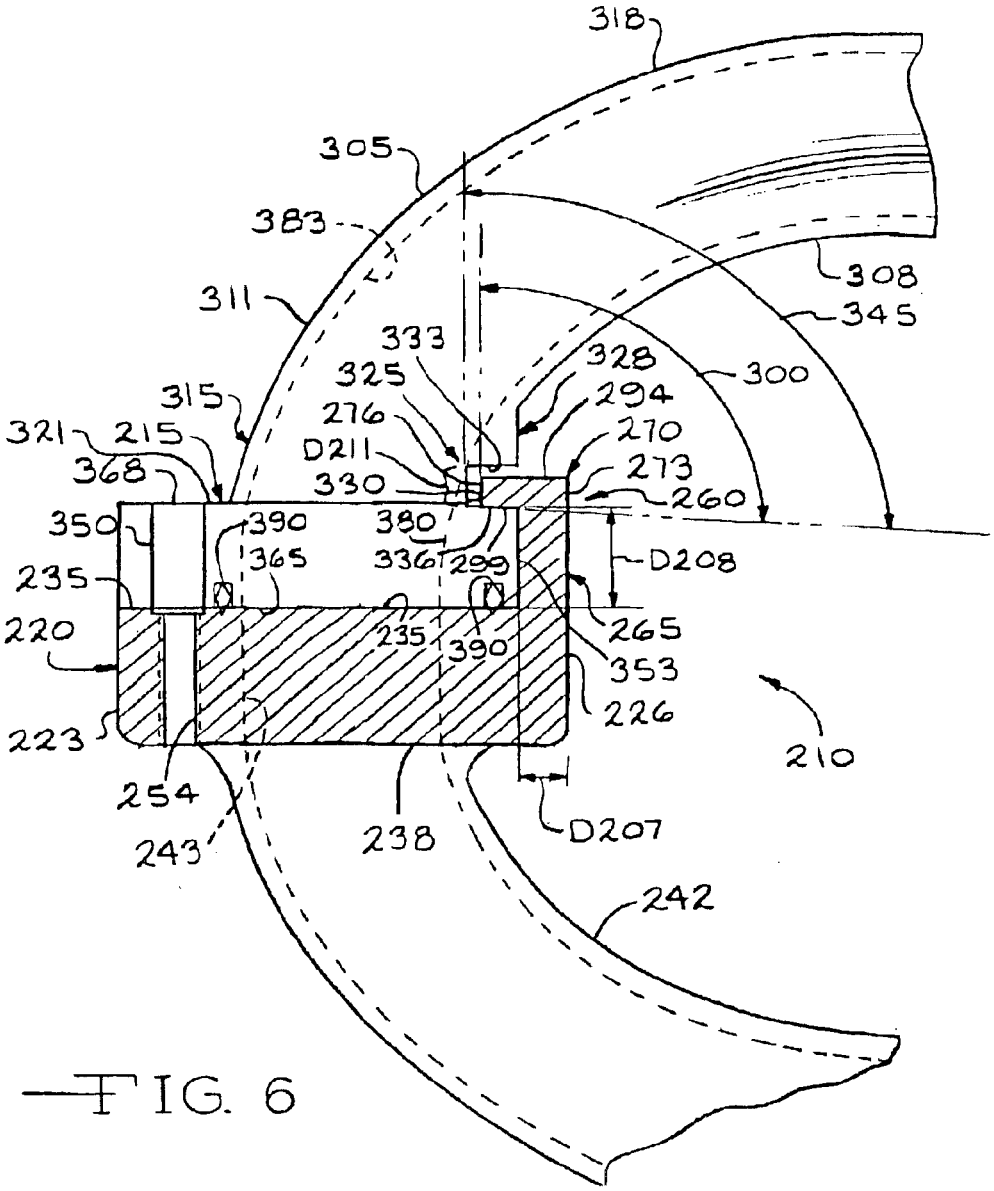
FIG. 6 is a sectional view of an air intake manifold assembly according to a second embodiment of the present invention, showing the lower manifold of FIG. 4 and the upper manifold of FIG. 5 joined together.

Referring now to the drawings, there is illustrated in FIGS. 4–6 a second embodiment of an air intake manifold, indicated generally at 210, in accordance with the present invention. For purposes of clarity in presentation, only those portions of the air intake manifold assembly 210 that are necessary for a complete understanding of this invention will be described. As illustrated in FIG. 6, the air intake manifold assembly 210 includes an upper body part or manifold 215 and a lower body part or manifold 220 operatively joined together in accordance with the mounting system of the present invention.

The lower manifold 220 is constructed from a suitable material, such as for example, plastic or aluminum. The lower manifold 220 includes a pair of opposed side walls 223 and 226, and a pair of opposed end walls 229 and 232. The side walls 223 and 226 extend generally parallel to one another, and the end walls 229 and 232 extend generally parallel to one another and generally transverse relative to the side walls 223 and 226. The side wall 223 defines a front wall and the side wall 226 defines a rear wall.

The lower manifold 220 includes one or more tubular shaped openings 242 extending therethrough, each opening 242 having an inner wall surface 243 for transportation of gases. In the illustrated embodiment, the lower manifold 220 includes six lower openings 242. The lower openings 242 all define a diameter D201. In the illustrated embodiment, the lower manifold 220 is provided with three front fastener holes 254 adjacent the front wall 223. As will be discussed below, the front fastener holes 254 are adapted to receive suitable fasteners to join the upper manifold 215 and the lower manifold 220 together. Any suitable number of front fastener holes 254 may be employed. The front fastener holes 254 may be threaded to receive a bolt, or may be adapted to receive any other suitable fastener. Alternatively, one or more of the front fastener holes 254 and corresponding fasteners could be eliminated.

In the illustrated embodiment, the lower manifold 220 is provided with two mounting tabs or projections, indicated generally at 260, extending from the rear wall 226. It should be noted that any suitable number of tabs 260 may be employed. In the illustrated embodiment, the tabs 260 are provided along the rear wall 226 in the space 245 and in the space 248. It should be noted that the tabs 260 may be provided at any suitable location on the lower manifold 220. For example, a mounting tab 260 may be provided in the space 251, or a single continuously extending mounting tab 260 may be employed that extends across a substantial portion of, or all, the rear wall 226.

In the illustrated embodiment, each mounting tab 260 includes a leg 265 (best shown in FIG. 6) and a foot 270. Preferably, the leg 265 and the foot 270 are formed integral with one another and integrally with the lower manifold 220. As will be discussed below, a bottom surface of the foot 270 of the mounting tab 260 is preferably located above the top surface 235 of the lower manifold 220 by a distance D208 (best shown in FIG. 6) and extends toward the front wall 223 so as to project over a portion of the top surface 235 of the lower manifold 220.

In the illustrated embodiment, the mounting tab 260 includes a rear wall 273 which is generally parallel to a front wall 276 of the foot 270 of the mounting tab 260. The rear wall 273 of the foot 270 defines a width W1, and the front wall 276 of the foot 270 defines a width W2 which is preferably less than the width W1. The rear wall 273 and the front wall 276 are spaced apart by a distance D205. The rear wall 273 of the mounting tab 260 is spaced from the rear wall 226 of the lower manifold 220 by a distance D207, and the front wall 276 of the mounting tab 260 projects over the top surface 235 and is spaced from the rear wall 226 by a distance D206.

The mounting tab 260 also includes two side walls 280 and 284. The two side walls 280 and 284 terminate at one end at the rear wall 273 and at the other end at the front wall 276. In the illustrated embodiment, the side walls 280 and 284 are tapered side walls. In particular, the side wall 280 is oriented at an angle 290 with respect to an axis A, and the side wall 284 is oriented at an angle 287 with respect to the axis A. In the illustrated embodiment, the angle 287 is preferably within the range of from about 45 degrees to about 75 degrees. The angle 290 is preferably within the range of from about 45 degrees to about 75 degrees. Alternatively, the side walls 280 and 284 can be other than illustrated if so desired.

In the illustrated embodiment, the foot 270 of the mounting tab 260 includes a top surface 294 and a bottom surface 299. The top surface 294 has a generally flat quadrilateral shape. In a preferred embodiment, the area of the top surface 294' forms a trapezoid, having only two sides parallel. The bottom surface 299 is spaced apart from the top surface 235 of the lower manifold 220 by a distance D208. The bottom surface 299 is oriented at an angle 300 relative to the front wall 276 of the foot 270 of the mounting tab 260. The angle 300 is within the range of from about 45 degrees to about 135 degrees and more preferably is within the range of from about 94 degrees to about 100 degrees.

The upper manifold 215 is formed from a suitable material, such as for example, plastic or aluminum and includes one or more tubular shaped openings or passageways 305. The passageways 305 have an arc profile that defines a generally tubular shape having an underside portion 308 and a generally tubular shaped outer surface 311. Each of the tubes 305 includes a first end 315 and an opposite second end 318. The first end 315 of the passageway 305 terminates at an upper mating plate 321. The second end 318 of the passageway 305 is adapted to be connected to an air supply chamber (not shown).

The upper manifold 215 is provided with one or more notches 325 formed therein. The number of notches 325 preferably corresponds with the number of tabs 260 provided on the lower manifold 220. In the illustrated embodiment, each notch 325 is provided along a portion of the outer surface 311 of the passageway 305. In the illustrated embodiment, a ledge or extension 328 is preferably provided above each notch 325 to provide support in the upper manifold 215 at each notch 325.

In the illustrated embodiment, each notch 325 includes a rear wall 330, an upper wall 333, a lower wall 336, and opposed side walls 339 and 342 (shown in FIG. 5). In the illustrated embodiment, the upper wall 333 of the notch 325 is oriented at approximately 90 degrees with respect to the rear wall 330 of the notch 325, and the rear wall 330 is oriented at an angle 345 with respect to the lower wall 336 of the notch 325. The angle 345 is within the range of from about 45 degrees to about 135 degrees and more preferably within the range of from about 94 degrees to about 100 degrees. Alternatively, the angle 345 may be any suitable angle. Preferably, the angle 300 is greater than the angle 345 with the difference between the two angles being around 5 degrees. The purpose of this difference in the angles is so the upper manifold 215 can be slid on the notches 325 at this angle (difference in the surfaces 235 and 365 is the same 5 degrees), so that gaskets 390 will not smear or roll over during assembly. Alternatively, the angles 300 and 345 can be other than shown and illustrated and/or can be different from one another is so desired. For example, the angle 345 of the upper manifold 215 and the angle 300 of the lower manifold 220 can be approximately equal to one another.

The upper manifold 215 and the lower manifold 220 are preferably positioned with respect to each other to cooperate as shown in FIG. 6. It will be appreciated that the top surface 294 of the foot 270 of the mounting tab 260 and the upper wall 333 of the notch 325 are preferably spaced apart, though they may touch. Likewise, the front surface 276 of the foot 270 of the mounting tab 260 and the rear wall 330 of the notch 325 are preferably spaced apart, though they may touch. Similarly, the side surface 280 and the side surface 284 are preferably spaced apart from the side wall 342 and the side wall 339, respectively, though they may touch. In a preferred embodiment, the bottom surface 299 of the foot 270 of the mounting tab 260 and the lower surface 336 of the notch 325 are substantially in contact. It should be noted that the notch 325 also preferably includes the distance D209 (shown in FIG. 5), distance D210 (shown in FIG. 5), and distance D211. It will be appreciated that the distance d9 of the notch 325 is equal to or greater than the width W202 of the front surface 276 of the foot 270 of the mounting tab 260 so as to allow the upper manifold 215 and the lower manifold 220 to cooperate as shown in FIG. 6. Likewise, it will be appreciated that the distance d10 of the notch 325 is equal to or greater than the distance D206 of the foot 270 of the mounting tab 260 so as to allow the upper manifold 215 and the lower manifold 220 to cooperate as shown in FIG. 6.

Referring now to FIG. 5, two notches 325 are illustrated in the upper manifold 215 shown. The rear wall 330 of the notch 325 preferably forms a right angle with the side wall 339 of the notch 325. Likewise, the rear wall 330 of the notch 325 preferably forms a right angle with the side wall 342 of the notch 325. It will be appreciated that the side wall 339 and the side wall 342 are preferably about parallel to each other. Similarly, the upper wall 333 of the notch 325 preferably forms a right angle to both the side wall 339 and the side wall 342.

The illustrated upper manifold 215 includes a front wall 350, which is generally parallel to a rear wall 353. The front wall 350 and the rear wall 353 terminate at a first wall 356 and a second wall 359. The upper manifold 215 also includes a generally flat upper mating plate 321 (best seen in FIG. 6) and a preferably generally flat bottom surface 365.

The illustrated upper manifold 215 includes three front fastener holes 368 provided along the front edge front wall 350 to receive a suitable fastener to join the upper manifold 215 to the lower manifold 220. Any suitable number of front fastener holes 368 may be employed, including zero. The front fastener holes 368 may be threaded to receive a bolt, or may be adapted to receive any other suitable fastener. The front fastener holes 368 of the upper manifold 215 preferably align with the front fastener holes 254 of the lower manifold 220.

In the illustrated embodiment, the notches 325 are provided along the rear wall 353 of the upper manifold 215. It should be noted that the notches 325 may be provided at any suitable location. It should be noted that any suitable number of notches 325 may be employed, including but not limited to zero or one. The number of notches 325 employed is preferably the same as the number of tabs 260. In a preferred embodiment, the notches 325 are provided near the first wall 356 in the space 374 and near the second wall 359 in the space 377. Also, a single notch 325 may be employed that extends across a substantial portion of, or all, the rear wall 353 of the upper manifold 215.

The illustrated upper manifold 215 includes one or more upper openings 380 extending therethrough for transportation of gases and having an inner surface 383. In a preferred embodiment, the upper manifold 215 includes six upper openings 380. The upper openings 380 preferably all have the same diameter D212, though any suitable set of diameters may be employed.

The illustrated upper manifold 215 includes one or more gaskets or seals 390. The gaskets 390 are preferably made of a suitable resilient material, such as silicon. It should be understood that the gaskets 390 may be made of any suitable resilient material. The gaskets 390 are preferably provided in a gasket groove G provided about the periphery of the openings 380. The gaskets 390 function to mate the bottom surface 365 of the upper manifold 215 to the top surface 235 of the lower manifold 220.

The upper manifold 215 and the lower manifold 220 are preferably made of nylon 66 (polyhexamethylene adipamide) or nylon 6 (polycaproamide). Other multipurpose plastics may also be employed. Of course, any suitable material, including metallic compounds, may be used to produce the upper manifold 215 and the lower manifold 220 according to conventional techniques in the art.

In accordance with the provisions of the patent statutes, the principle and mode of operation of this invention have been described and illustrated in its preferred embodiments. However, it must be understood that the invention may be practiced otherwise than as specifically explained and illustrated without departing from the scope or spirit of the attached claims.

What is claimed is:

1. A mounting system for an air intake manifold assembly adapted for use with an internal combustion engine comprising;

an upper body part having at least one opening formed therethrough; and a lower body part having at least one opening formed therethrough in registration with at least a portion of said opening of said upper body part;

wherein one of said upper body part and said lower body part includes a notch provided in a surface thereof and the other said one of said upper body part and said lower body part includes a mounting tab extending from a surface thereof, said mounting tab and said notch having a construction which enables said mounting tab to be disposed into said notch to thereby join said upper body part and said lower body part together, and wherein said upper body part includes at least one fastening hole, said lower body part includes at least one fastening hole in registration with said fastening hole of said lower body part, and a fastener is disposed in said fastening holes to secure said upper body part and said lower body part together.

2. The mounting system for the air intake manifold assembly according to claim 1 wherein said upper body part includes said notch and said lower body part includes said mounting tab.

3. The mounting system for the air intake manifold assembly according to claim 1 wherein said upper body part includes said mounting tab and said lower body part includes said notch.

4. The mounting system for the air intake manifold assembly according to claim 1 wherein said mounting tab includes two side walls and said lower body part includes a rear wall and an axis oriented about perpendicular to said rear wall and at least one of said two side walls is oriented with respect to the said rear wall at an angle within the range of from about 45 degrees to about 75 degrees.

5. The mounting system for the air intake manifold assembly according to claim 1 wherein said mounting tab includes a foot positioned to extend over said lower body part, said foot having a front wall wherein said bottom wall of said mounting tab is oriented at an angle relative to said front wall of said foot of said mounting tab and said angle is within the range of from about 45 degrees to about 135 degrees.

6. The mounting system for the air intake manifold assembly according to claim 5 wherein said angle is within the range of from about 94 degrees to about 100 degrees.

7. The mounting system for the air intake manifold assembly according to claim 1 wherein said mounting tab includes two side walls, said two side walls being positioned to taper with respect to each other and wherein said lower body part includes a rear wall and an axis oriented about perpendicular to said rear wall and at least one of said two side walls is oriented with respect to said rear wall at an angle within the range of from about 45 degrees to about 75 degrees and wherein said mounting tab includes a foot positioned to extend over said lower body part, said foot having a front wall wherein said bottom wall of said mounting tab is oriented at an angle relative to said front wall of said foot of said mounting tab and said angle is within the range of from about 45 degrees to about 135 degrees.

8. The mounting system for the air intake manifold assembly according to claim 1 further comprising a lower manifold.

9. The mounting system for the air intake manifold assembly according to claim 8 wherein said lower manifold supports said lower body part.

10. The mounting system for the air intake manifold assembly according to claim 8 wherein said lower manifold is in communication with said upper body part and said lower body part.

11. The mounting system for the air intake manifold assembly according to claim 1 wherein said upper body part and said lower body part are in communication.

12. A mounting system for an air intake manifold assembly for attaching an upper manifold of an intake manifold to a lower manifold of the intake manifold, comprising:

a notch, wherein said notch includes a lower surface and said notch is formed in said upper manifold;

a mounting tab, wherein said mounting tab includes a bottom wall and said mounting tab is formed in said lower manifold;

wherein substantial portions of said lower wall of said notch and substantial portions of said bottom wall of said mounting tab contact to couple said upper manifold of the intake manifold and said lower manifold of the intake manifold, and wherein said mounting tab includes two side walls, said two side walls being positioned to taper with respect to each other.

13. The mounting system for the air intake manifold assembly according to claim 12 wherein said lower manifold includes a rear wall and an axis oriented about perpendicular to said rear wall and at least one of said two side walls is oriented with respect to said rear wall at an angle within the range of from about 45 degrees to about 75 degrees.

14. The mounting system for the air intake manifold assembly according to claim 12 wherein the said mounting tab includes a foot positioned to extend over said lower manifold, said foot having a front wall wherein said bottom wall of said mounting tab is oriented at an angle relative to said front wall of said foot of said mounting tab and the angle is within the range of from about 45 degrees to about 135 degrees.

15. The mounting system for the air intake manifold assembly according to claim 14 wherein the said angle is within the range of from about 94 degrees to about 100 degrees.

16. The mounting system for the air intake manifold assembly according to claim 12 wherein said lower manifold includes a rear wall and an axis oriented about perpendicular to said rear wall and at least one of said two side walls is oriented with respect to said rear wall at an angle within the range of from about 45 degrees to about 75 degrees and wherein said mounting tab includes a foot positioned to extend over said lower manifold, said foot having a front wall wherein said bottom wall of said mounting tab is oriented at an angle relative to said front wall of said foot of said mounting tab and said angle is within the range of from about 45 degrees to about 135 degrees.

* * * * *